US005967162A

United States Patent [19]

Bolton

[11] Patent Number: 5,967,162

[45] **Date of Patent: *Oct. 19, 1999**

[54] MOBILE SHELTER

[76] Inventor: Mark Alan Bolton, P.O. Box 707, Mt. Pleasant, S.C. 29465

[ * ] Notice: This patent is subject to a terminal disclaimer.

[21] Appl. No.: 08/821,977

[22] Filed: Mar. 20, 1997

[51] Int. Cl.[6] ..... E04H 15/34

[52] U.S. Cl. ..... 135/122; 135/124; 135/912; 239/225.1; 239/722

[58] Field of Search ..... 135/121, 122, 135/124, 905, 906, 912; 52/64, 86, 63; 239/225.1, 722, 172

[56] References Cited

U.S. PATENT DOCUMENTS

| | | | |
|---|---|---|---|
| 223,468 | 1/1880 | Benthall . | |
| 247,856 | 10/1881 | Taylor . | |
| 620,109 | 2/1899 | Downer | 135/912 X |
| 659,114 | 10/1900 | Voorhies . | |
| 1,128,558 | 2/1915 | Voorhies . | |
| 2,575,572 | 11/1951 | Wickstrum | 135/912 X |
| 2,603,171 | 7/1952 | Smith | 52/66 |
| 2,693,195 | 11/1954 | Frieder et al. | 135/122 |
| 2,844,156 | 7/1958 | Reiman | 135/121 X |
| 2,845,078 | 7/1958 | Singleton | 135/121 |
| 3,530,623 | 9/1970 | Burton | 52/86 |
| 4,068,679 | 1/1978 | Pringle et al. . | |
| 4,136,826 | 1/1979 | Ausherman . | |
| 4,209,068 | 6/1980 | Corsentino . | |
| 4,763,836 | 8/1988 | Lyle et al. . | |
| 4,898,198 | 2/1990 | Castlebury . | |
| 4,948,289 | 8/1990 | Dellinger | 135/912 X |
| 5,575,301 | 11/1996 | Bolton . | |

FOREIGN PATENT DOCUMENTS

| | | |
|---|---|---|
| 60-18485 | 1/1985 | Japan . |
| 0346997 | 7/1960 | Switzerland . |

*Primary Examiner*—Carl D. Friedman
*Assistant Examiner*—Winnie S. Yip
*Attorney, Agent, or Firm*—Phelps Dunbar, LLP

[57] ABSTRACT

A mobile shelter which provides a canopy that protects from sun and rain. The canopy is mounted on a series of curved rib units that are connected to a triangular support system which is attached at each end to a truncated A-Frame support on wheels. The shelter is high enough to provide adequate clearance for activities such as golf. The shelter can span distances of up to 200 feet or more, and the canopy may be retractable.

6 Claims, 3 Drawing Sheets

MOBILE SHELTER

BACKGROUND OF THE INVENTION

1. Field of the Invention

This invention relates to shelters for use in protecting people, animals, plants or any other items from the elements, including sun and rain, and specifically to such shelters that are mobile. The preferred embodiment of this invention is particularly well suited to protection of golfers at practice facilities.

2. Description of Related Art

The prior art reveals mobile shelters, but only on a very small scale, such as for an individual agricultural worker. The prior art does not reveal a mobile shelter capable of protecting numerous people from the elements while involved in an outdoor activity, such as golf, archery or the like.

SUMMARY OF THE INVENTION

In accordance with the invention, a free-standing, self supporting, mobile structure is provided that supports a canopy of lightweight fabric or plastic. The fabric or plastic canopy may block all or some portion of the rays of the sun, and may be totally or partially impervious to rainfall. The shelter can be provided in various lengths, up to 200 feet or more, and can provide sufficient clearance underneath the canopy for various activities, including golf or archery, for example. The width of the shelter is sufficient to adequately protect those underneath the shelter from sun and rain. The shelter is mounted on wheels, so that it is entirely mobile, and may be self propelled, or provide for easy connection to a tractor or other device for moving. The canopy may be retractable, either through the use of a motor-driven or manual system which pulls the canopy back to one side of the support structure.

DETAILED DESCRIPTION OF THE DRAWINGS

Figure 1:
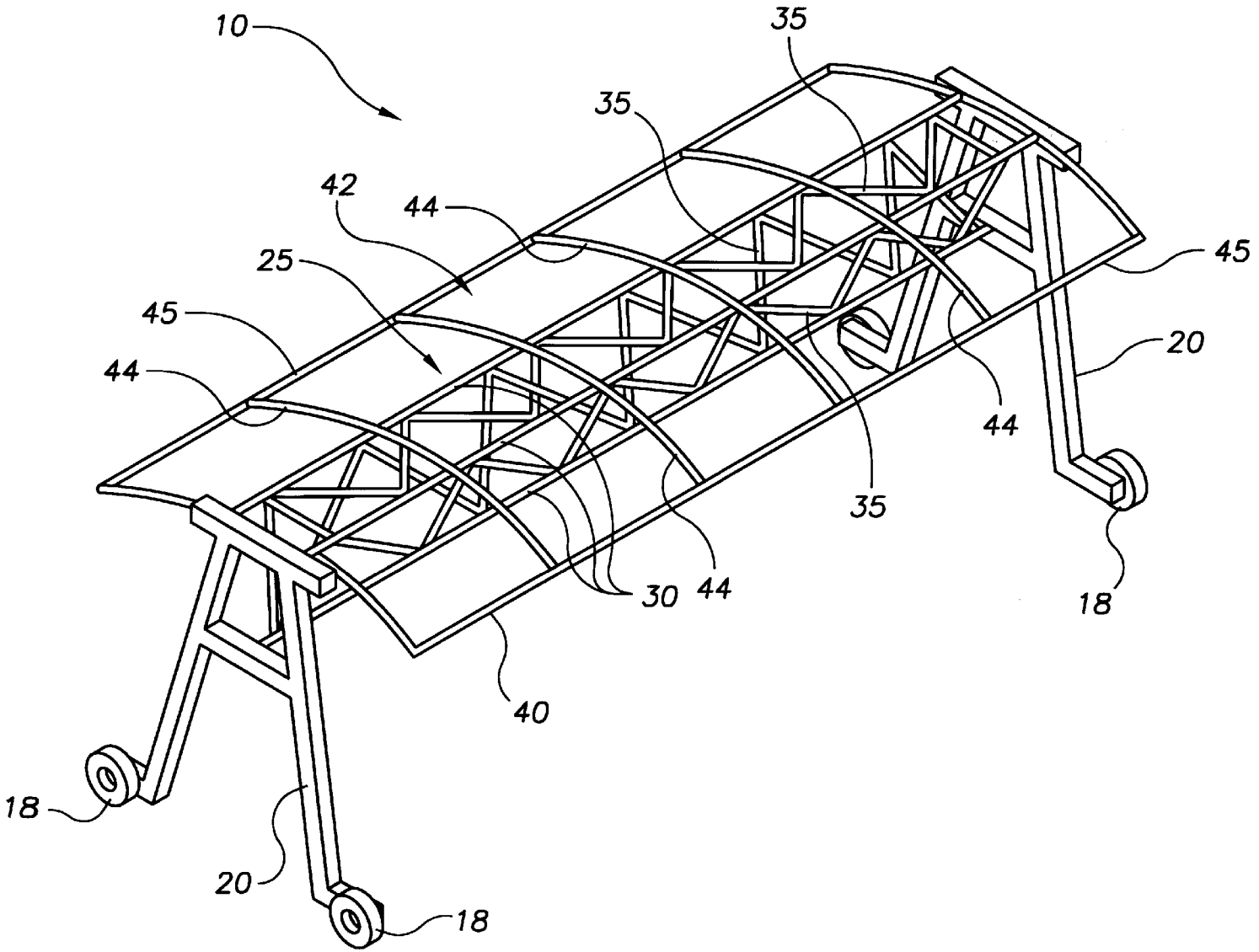
FIG. 1 is a perspective view of the mobile shelter of the present invention.
Figure 2:
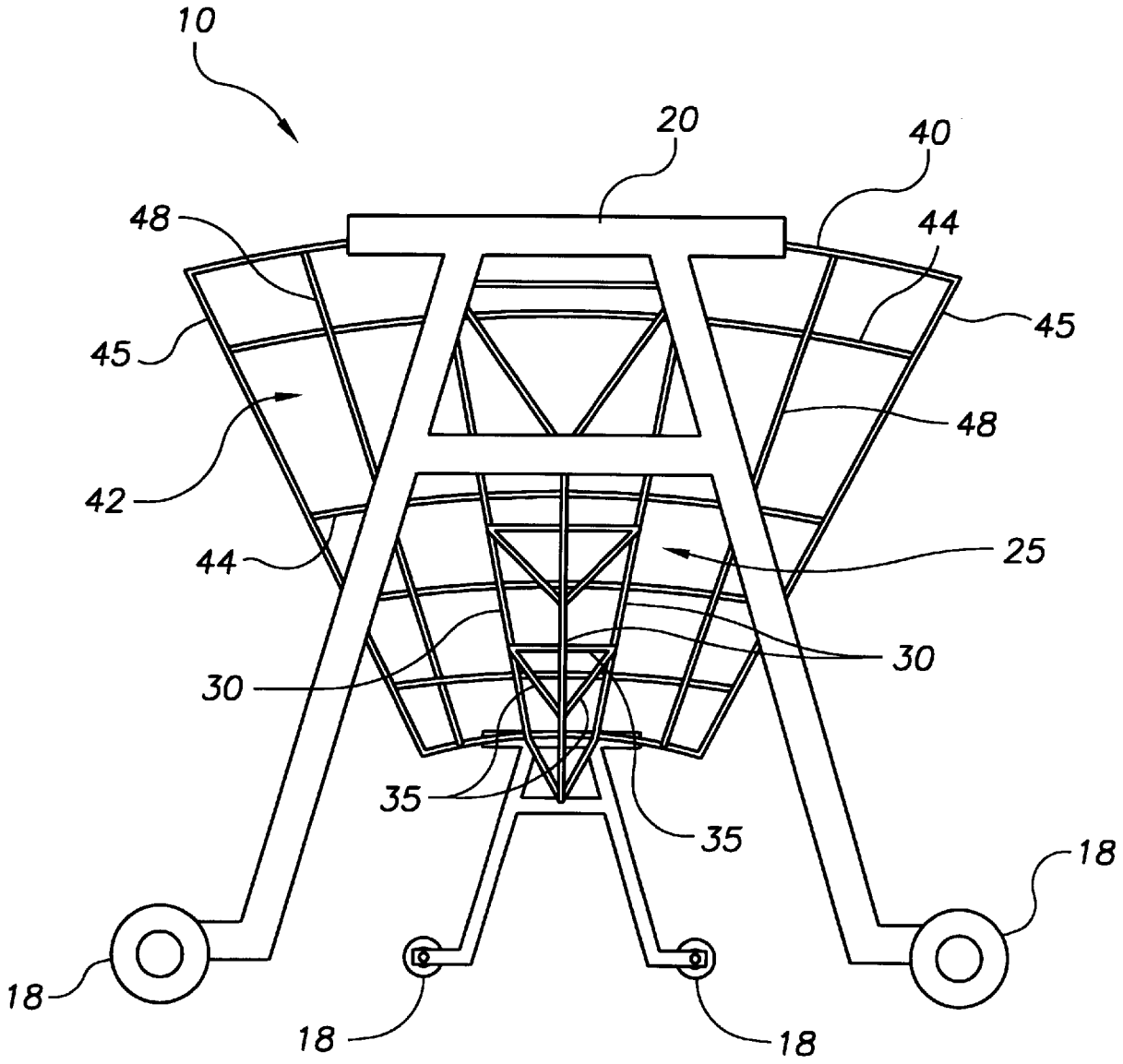
FIG. 2 is a partial perspective view of the support structure of the mobile shelter of the present invention.
Figure 3:
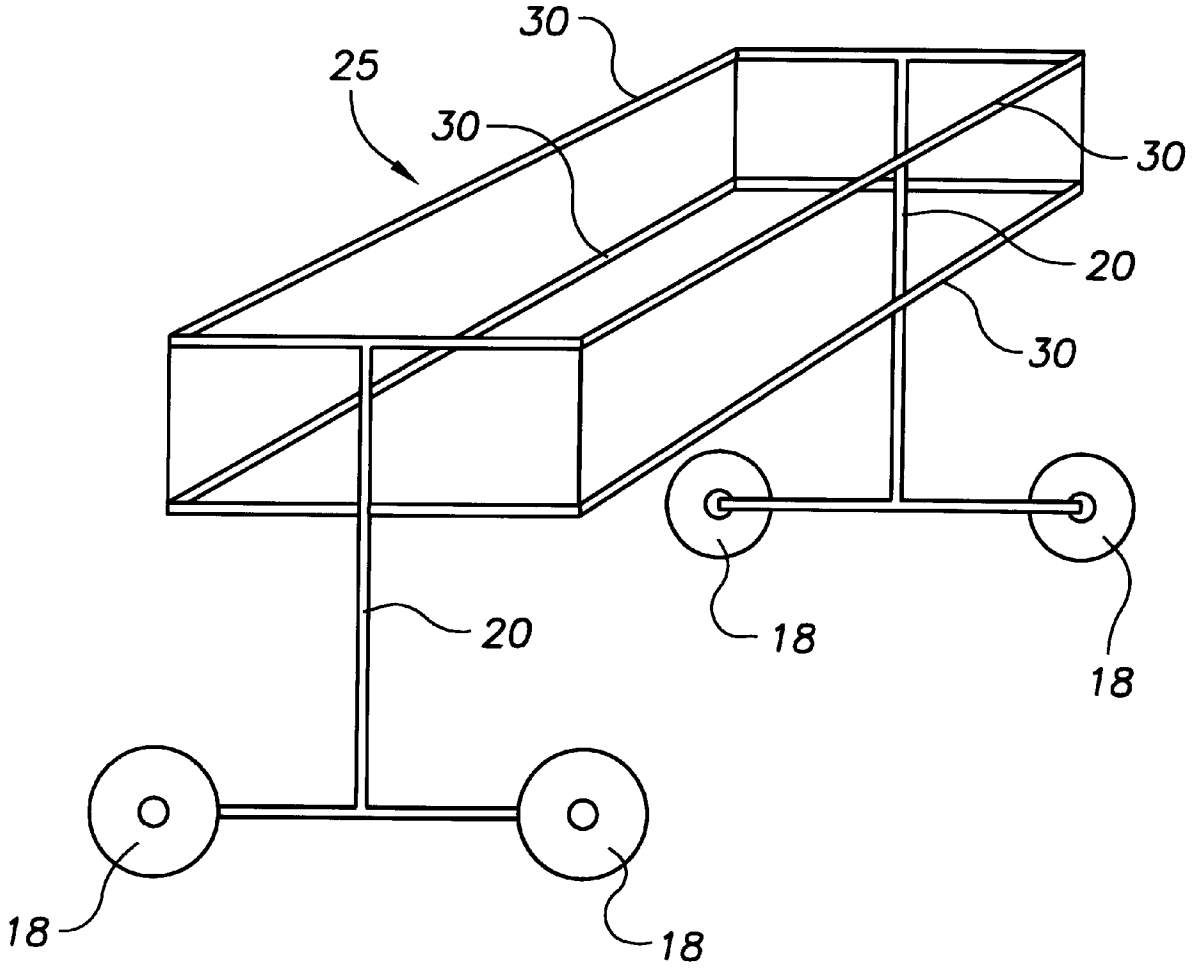
FIG. 3 is a partial perspective view of the support structure of another embodiment of the mobile shelter of the present invention.

FIG. 1 shows in perspective the mobile shelter (10). The shelter is supported by two wheeled end support units (20), one on each end of a canopy support section (25). The preferred end support unit (20) is a truncated A-Frame structure. These end support units are sized such that they provide adequate clearance underneath the structure for activities such as golf. Clearance of 12 feet is typical of the height of this invention. Variations on the truncated A-Frame structure include an I-Frame, or other structures which provide adequate support for the canopy support section (25), and which provide adequate height for the activities conducted under the mobile shelter. As can be seen in FIG. 1, the two end support units (20) are connected by a long canopy support section (25). The canopy support section (25) may be a variety of designs, including a tri-chord design. The tri-chord design includes three primary span support members (30), configured to provide a cross section generally defined as an isosceles triangle. A plurality of cross braces (35) are provided between the three primary span support members (30) to strengthen the canopy support section (25). The primary span support members (30) may be made from a variety of material, including flanged pipe. Flanged pipe facilitates the connection of varying lengths of pipe to create different length spans, as well as the connection of the primary support members (30) to the wheeled end support units (20). The cross braces (35) are generally made from material smaller in diameter or cross section than the primary span support members (30), and may be connected to the primary span support members (30) in a variety of means, including welding and bolting.

The tri-chord design of the canopy support section (25) can support spans of up to 200 feet. Common spans for use at recreational facilities include 41, 62 and 83 feet. Other designs of the canopy support section (25), in addition to the tri-chord design, could efficiently support the canopy unit (40) over such spans, including a quad-chord design, where four primary span support members (30) are utilized. The cross section formed by the four primary span support members (30) in the quad-chord design would be a square or rectangle.

The two wheeled end support units (20) and canopy support section (25) form the weight supporting portion of the mobile shelter (10). The wheels (18) of the mobile shelter (10) should be of sufficient size to not only support the structure, but provide for easy movement over uneven terrain. Uses of the device suggest that movement of the structure in pastures and fields may be needed, requiring pneumatic tires of sufficient radius. For example, 24 inch by 12 inch tires will facilitate movement in most applications. Smaller radius tires will be adequate for most recreational facilities. The wheels (18) should be capable of pivoting up to 90 degrees, to allow for easy movement of the mobile shelter (10) in four directions. The wheels can be connected to motors to enable the unit to be moved without the need for towing or pushing equipment. Alternatively, connections (not shown) can be provided to the wheeled end support units (20) for attachment to equipment that can tow or push the mobile shelter (10) to a new location.

The canopy unit (40) is comprised of the canopy fabric (42), canopy support ribs (44), and canopy cross bars (45). The canopy support ribs (44) are placed at intervals along the span of the mobile shelter (10), as best seen in FIG. 1. A preferred interval distance is every 4 feet. Each support rib (44) is connected (such as by bolting or welding) to the uppermost primary span support members (30), and lies in a plane generally parallel to the plane of the wheeled end support units (20). In addition, each support rib (44) is connected to two canopy cross bars (45). These cross bars (45) extend the length of the shelter and are connected to the end of each support rib (44). It is preferred that the support ribs (44) provide a curved consistent surface over which to stretch the fabric or plastic canopy (42), although a flat or boxed surface would be suitable as well. One embodiment of the invention provides a mechanism for retracting the canopy (42) by rolling it up toward one side of the shelter. This may be accomplished by use of a rotating rod which is attached to the canopy and extends adjacent to one of the canopy cross bars (45). The rod could be rotated manually or with a motor. The support ribs (44) may be sized to provide the needed area of protection. A preferred width provided by the support ribs (44) is approximately 15 feet. It may be desirable to attach the canopy fabric (42) to the support ribs (44) in a manner which allows the canopy fabric (42) to separate from the support ribs (44) in high winds, in order to prevent the entire structure from being damaged. If needed, stabilizer braces (48) may be placed at intervals between one or both of the canopy cross bars (45) and the closest lower primary span support member (30). A suitable interval can be every 10 feet.

The canopy support section (25) should be of sufficient strength not only to support the canopy (42) and canopy support ribs (44), but also various devices which may be desired, such as ceiling fans, heaters, misters, lights, and speakers. Those using the mobile shelter (10) may be further protected from the elements by the addition of side or back drapes which hang from a canopy cross bar (45) or from the side of a wheeled end support unit (20). Information such as advertisements can appear on the canopy fabric (42) and any side and back drapes as well.

Although the present invention has been described in connection with preferred forms thereof, it will be appreciated that additions, modifications, substitutions, and deletions may be made without departing from the spirit and scope of the invention.

What I claim is:

1. A mobile shelter comprising;

two end support structures, a plurality of wheels connected to said two end support structures, four primary connecting members, wherein said four primary connecting members form a generally square cross section, a plurality of rib units connected to at least one of said primary connecting members at intervals along the length of said primary connecting members, wherein said plurality of rib units provide a support surface, and a canopy which is supported by and connected to said plurality of rib units.

2. A mobile shelter comprising;

two end support structures, a plurality of wheels connected to said two end support structures, four primary connecting members, wherein said four primary connecting members form a generally rectangular cross section, a plurality of rib units connected to at least one of said primary connecting members at intervals along the length of said primary connecting members, wherein said plurality of rib units provide a support surface, and a canopy which is supported by and connected to said plurality of rib units.

3. A mobile shelter comprising;

two end support structures formed in the shape of a truncated "A", a plurality of wheels connected to said two end support structures, three primary connecting members, connecting said two end support structures to each other, wherein said three primary connecting members form a generally inverted triangular cross section, a plurality of rib units connected to at least one of said primary connecting members at intervals along the length of said primary connecting members, wherein said plurality of rib units provide a support surface, and a canopy which is supported by and connected to said plurality of rib units.

4. A mobile shelter comprising;

two end support structures formed in the shape of an "I", a plurality of wheels connected to said two end support structures, three primary connecting members, connecting said two end support structures to each other, wherein said three primary connecting members form a generally inverted triangular cross section, a plurality of rib units connected to at least one of said primary connecting members at intervals along the length of said primary connecting members, wherein said plurality of rib units provide a support surface, and a canopy which is supported by and connected to said plurality of rib units.

5. A mobile shelter comprising;

two end support structures formed in the shape of a truncated "A", a plurality of wheels connected to said two end support structures wherein said plurality of wheels can pivot 90 degrees, three primary connecting members connecting said two end support structures to each other, wherein said three primary connecting members form a generally isosceles triangular cross section, with the point of the triangle that joins two sides of approximate equal distance being oriented in a downward direction, a plurality of cross braces connecting said primary connecting members adjacent to each other at intervals along the length of said primary connecting members, a plurality of curved rib units connected to the uppermost two of said primary connecting members at intervals along the length of the uppermost two of said primary connecting members, wherein said plurality of rib units provide a curved support surface, two canopy cross bars connected to the adjacent ends of each of said rib units whereby said canopy cross bars are perpendicular to the planes in which said rib units lie, and a canopy which is supported by and connected to said plurality of rib units.

6. A mobile shelter comprising;

two end support structures formed in the shape of a truncated "A", a plurality of wheels connected to said two end support structures wherein said plurality of wheels can pivot 90 degrees, four primary connecting members connecting said two end support structures to each other, wherein said four primary connecting members form a generally square cross section, a plurality of cross braces connecting said primary connecting members adjacent to each other at intervals along the length of said primary connecting members, a plurality of curved rib units connected to the uppermost two of said primary connecting members at intervals along the length of the uppermost two of said primary connecting members, wherein said plurality of rib units provide a curved support surface, two canopy cross bars connected to the adjacent ends of each of said rib units whereby said canopy cross bars are perpendicular to the planes in which said rib units lie, and a canopy which is supported by and connected to said plurality of rib units.

* * * * *